United States Patent [19]

Langlois et al.

[11] Patent Number: 4,829,715

[45] Date of Patent: May 16, 1989

[54] MACHINES FOR GRINDING AND BEVELLING OPHTHALMIC GLASSES

[75] Inventors: Jean-Pierre M. F. Langlois, Cleon; Michel J. Lecerf, La Saussay, both of France

[73] Assignee: Briot International, France

[21] Appl. No.: 162,880

[22] Filed: Mar. 2, 1988

[30] Foreign Application Priority Data

Mar. 5, 1987 [FR] France ..... 87 02992

[51] Int. Cl.[4] ..... B24B 17/00

[52] U.S. Cl. ..... 51/101 LG; 51/284 E; 51/165.75

[58] Field of Search ..... 51/101 LG, 103 R, 105 R, 51/105 LG, 106 LG, 165.71, 16.5.75, 284 E

[56] References Cited

U.S. PATENT DOCUMENTS 4,596,091 6/1986 DaBoudet et al. ..... 51/101 LG
4,667,444 5/1987 Langlois et al. ..... 51/101 LG

FOREIGN PATENT DOCUMENTS 274860 12/1986 Japan ..... 51/101 LG
274861 12/1986 Japan ..... 51/101 LG

*Primary Examiner*—James G. Smith
*Attorney, Agent, or Firm*—McGlew & Tuttle

[57] ABSTRACT

This machine comprises a carriage movable in translation and in oscillation in a direction parallel to and perpendicular to a shaft carrying trimming and bevelling grinding wheels, and further comprises a tracer (7) adapted to come in contact with the edge of a trimmed blank (3) of the glass in a direction perpendicular to this edge, and adapted to measure the distance L1 of the edge of the front side of the glass (3) relative to the edge of a planar glass in respect of which L1=0, and the value L2 which corresponds to the thickness of the edge of the glass. The tracer (7) has a curvature which is identical to and concentric with the curvature of the grinding wheel (4, 11) and formed by a plurality of parallel elements (9) acting on a sensor (10).

10 Claims, 3 Drawing Sheets

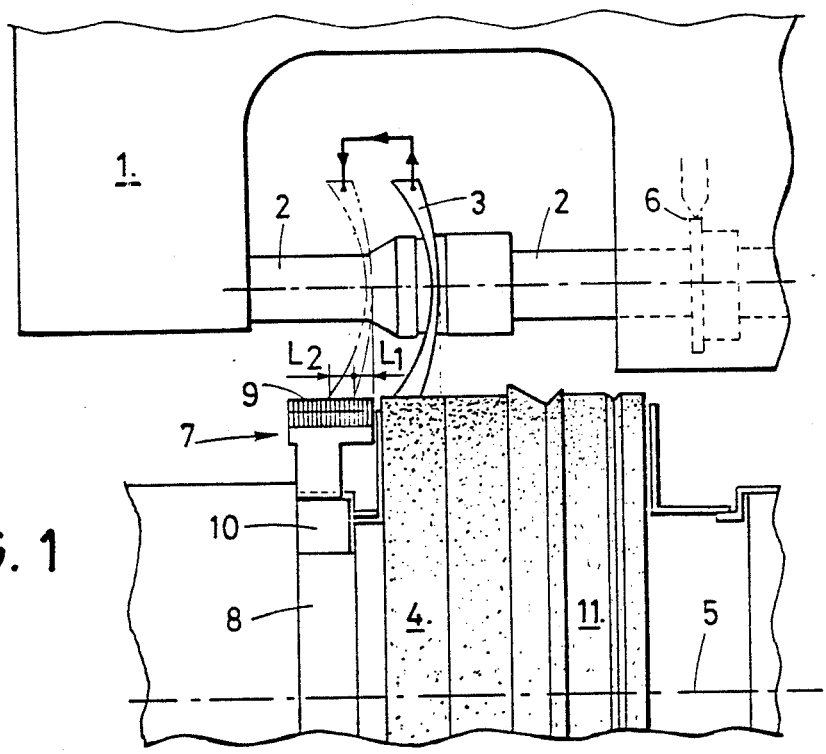
FIG. 1
FIG. 2
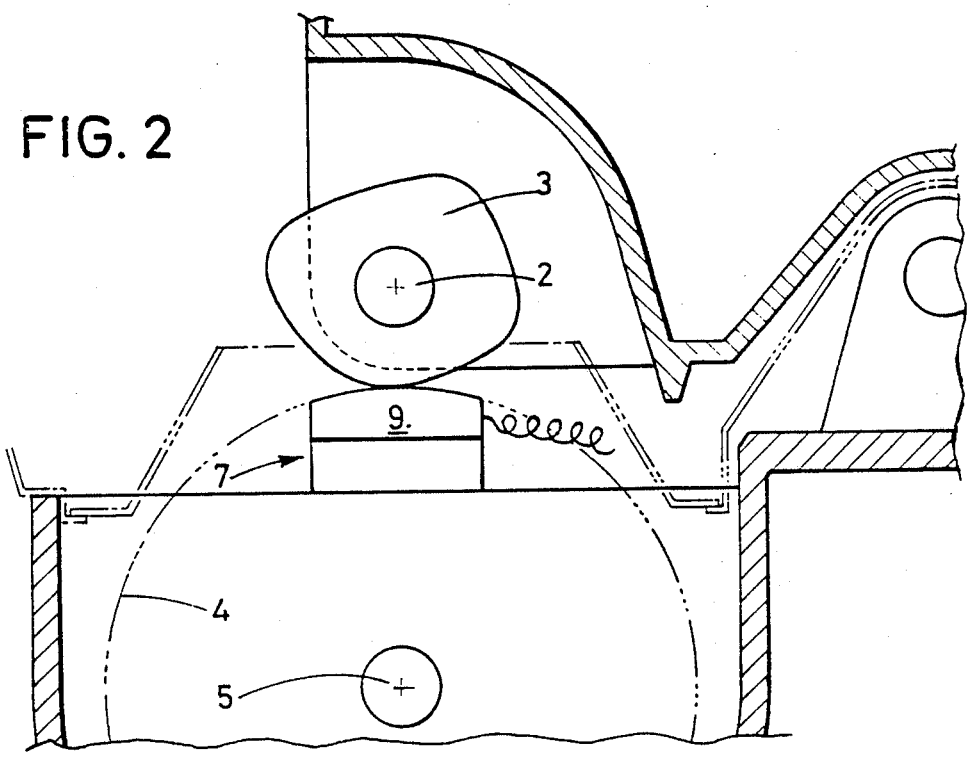

MACHINES FOR GRINDING AND BEVELLING OPHTHALMIC GLASSES

FIELD AND BACKGROUND OF THE INVENTION

The present invention relates to automatic machines for grinding and bevelling the glasses of spectacles.

Conventional machines for grinding and bevelling ophthalmic glasses comprise a U-shaped carriage slidably and pivotally mounted on a fixed horizontal shaft, a second horizontal shaft mounted to be rotatable perpendicularly between the branches of the U-shaped carriage, formed by two parts between which the glass to be worked on is clamped, and a third horizontal rotary shaft carrying the various grinding wheels for trimming and bevelling.

When a blank of an optical glass having a thick edge has been cut out in the shape of the frame, the edge of the glass has a cylindrical shape and a bevelling operation must be carried out by guiding the glass so as to form upon its edge a V-sectioned bevel located between the edges of its periphery, this bevel being intended to be engaged in the groove of the bezel of the frame.

Producing such a bevel with a manual control is extremely difficult; recourse has been had to the "free" bevel system in which the edge of the blank is brought into a V-sectioned groove of a grinding wheel and the shaft carrying the glass is allowed to be free to move in translation during the grinding operation.

However, this system does not give a fully satisfactory result.

FR-A-2,456,304 discloses a device for measuring the distance between a given point of the desired contour of an ophthalmic glass and the plane tangent to the pole of the convex surface of this glass.

This device comprises a unit having two tracers, one of which cooperates with the glass and the other with the template mounted on the carriage and movable in a direction parallel to the axis of the template and glass, one of the tracers being in contact with the surface of the glass.

As the glass rotates, the tracer in contact with its surface provides an indication by shifting an index in front of a graduated index.

In this device, following only a single point of a glass for a given angle of the latter requires effecting a correcting calculation owing to the fact that the grinding point moves in a different way depending on the diameter of the grinding wheel and the non-circular shapes of the frames.

SUMMARY AND OBJECTS OF THE INVENTION

An object of the invention is therefore to provide an automatic machine for grinding and bevelling ophthalmic glasses of the type comprising a tracer and in which this correcting calculation is unnecessary.

Another object of the invention is to provide a device for producing a bevel guided on the edge of an ophthalmic glass automatically and with high precision.

The invention therefore provides a machine for grinding and bevelling ophthalmic glasses of the type comprising a carriage movable in translation and in oscillation in a parallel and a perpendicular direction relative to the shaft carrying the grinding wheels for shaping and bevelling, and a tracer in contact with the glass, wherein the tracer is adapted to come in contact with the edge of a trimmed blank in a direction perpendicular to said edge, and is adapted to measure the distance L1 from the edge of the front surface of the glass blank to a plane passing through the front-most surface of the glass blank (for a blank with no curvature planar glass L1=0), the tracer also measures the value L2 which corresponds to the thickness of the edge of the glass.

According to another feature of the invention, the tracer has a surface whose curvature is identical to that of the grinding wheel.

Preferably, the surface of the tracer is formed by the adjacent edges of a plurality of juxtaposed and movable thin plates adapted to act on sensors responsive to the displacements of these plates.

According to an embodiment, the tracer is disposed on one side of the grinding wheel and the curvature of its surface is concentric with that of the grinding wheel.

In a modification, the tracer is movably mounted above the grinding wheel so as to be movable in a direction perpendicular to the shaft of the grinding wheel between an upper position remote from the blank and a lower position in which it is elastically biased into contact with the edge of the blank.

Advantageously, the tracer is constituted by three juxtaposed movable elements.

The following description, with reference to the accompanying drawings, given by way of a non-limitative example, will explain how the invention can be carried out.

BRIEF DESCRIPTION OF THE DRAWINGS

In the drawings

FIG. 1 is a partial diagrammatic view of a conventional grinding and bevelling machine to which the invention is applied.

FIG. 2 is an end elevational view thereof.

DESCRIPTION OF THE PREFERRED EMBODIMENTS

Figure 3:
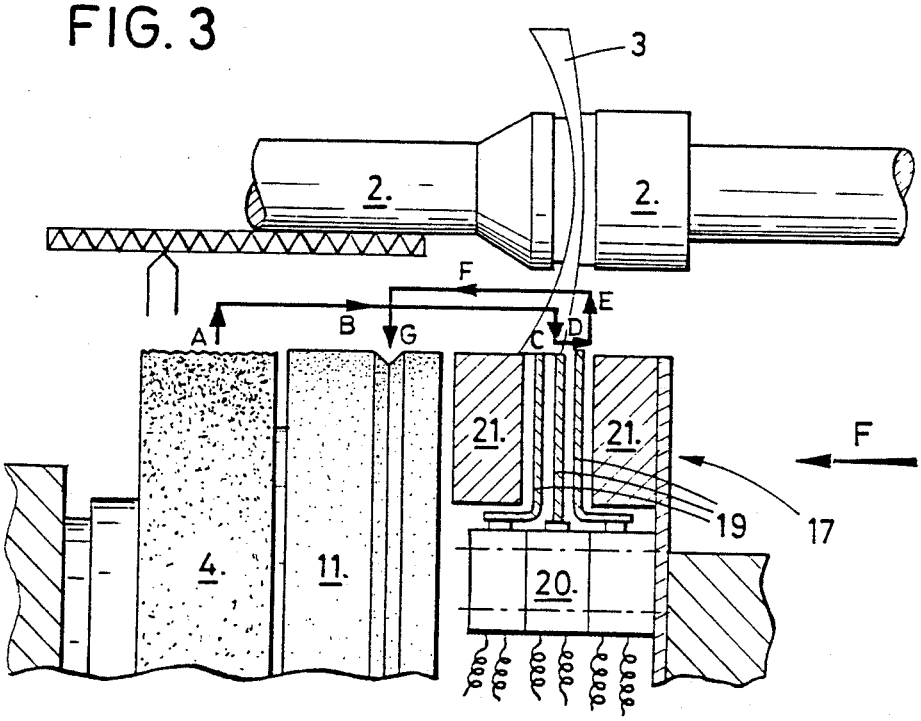
FIG. 3 is a partial diagrammatic view, to an enlarged scale, of the positioning of the edge of a blank on the tracer and the arrangement of an embodiment of the latter.

With reference to the drawings and more particularly to FIGS. 1 and 2, a conventional grinding and bevelling machine comprises a U-shaped carriage 1 pivotally mounted on a horizontal shaft (not shown) between the branches of which carriage is rotatably mounted a second horizontal shaft 2 in two parts including a clamp 120 between which is clamped a blank 3 of an ophthalmic glass which had been trimmed on a grinding wheel 4 rotatably mounted on a third horizontal shaft 5.

In the known way, the machine includes a sensor 6 of the angular position of the blank 3 in rotation and another sensor (not shown) detecting the position of the carriage 1 in translation in a direction parallel to the shaft 2.

In operation, the carriage 1 is lowered in order to bring the blank 3 in contact with the grinding wheel 4.

According to the invention, the machine comprises a tracer, generally designated by the reference character 7, having a surface defining a curvature which is identical to and concentric with that of the grinding wheel 4 and mounted adjacent to the latter on a suitable support 8.

The tracer 7, whose internal arrangement is not part of the invention and may be mechanical, pneumatic, magnetic, electronic or of some other construction, has a curved surface 130 formed by the edges of a plurality of plates or thin strips 9 which are movable, parallel, adjacent, mounted vertically on edge and acting independently on a device 10 responsive to a pressure exerted on the plates or strips for delivering an electric signal representing the number of plates on which this pressure is exerted.

With the knowledge of the thickness of the plates 9, the tracer 7 can therefore provide a measurement of the width of its surface against which bears the edge of a trimmed blank 3 brought in contact therewith by a displacement of the carriage 1.

If the front edge of the blank 3 is brought in coincidence with the edge of the tracer 7 L2 may be measured. If the blank 3 is then displaced by bringing the plane 100 passing through the front-most surfaced of the blank, perpendicular to the central axis 110, to the edge of the tracer 7, the tracer 7 delivers the measurement L1.

By rotating the blank 3 on the tracer 7, a series of measurements of L1 and L2 may be obtained throughout the periphery of the blank. The corresponding signals stored in a microprocessor then permit a very precise control of the motor shifting the carriage 1 in translation after having placed the edge of the blank on the bevelling grinding wheel 11.

Figure 4:
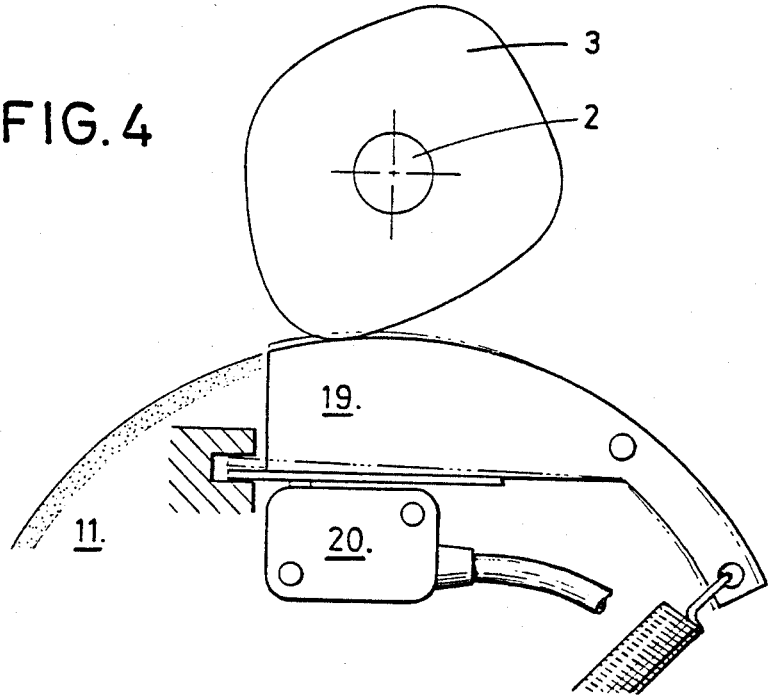
FIG. 4 is a partial end elevational view in the direction of arrow F of FIG. 3.

An embodiment of a tracer 17 has been shown in FIGS. 3 and 4 and comprises three plates 19 pivotally mounted and acting on three sealed sensors 20. The total width of the tracer corresponds to the maximum total thickness of an ophthalmic glass, namely 20 mm.

The tracer is limited by lateral abutments 21 for detecting the front and rear sides of the blank.

In this embodiment, a part of the edge of the blank 3 is always in contact with the central plate 19. A reading is made on the tracer of the measurements of the front side of the blank for a complete revolution of the latter, and then the same procedure is carried out for the rear side. The measurements read off the tracer will be stored for each angle read by the sensor 6 of the angular position of the blank and thereafter employed by the microprocessor for controlling the displacements of the carriage in translation for producing the bevel on the grinding wheel 11.

Figure 5:
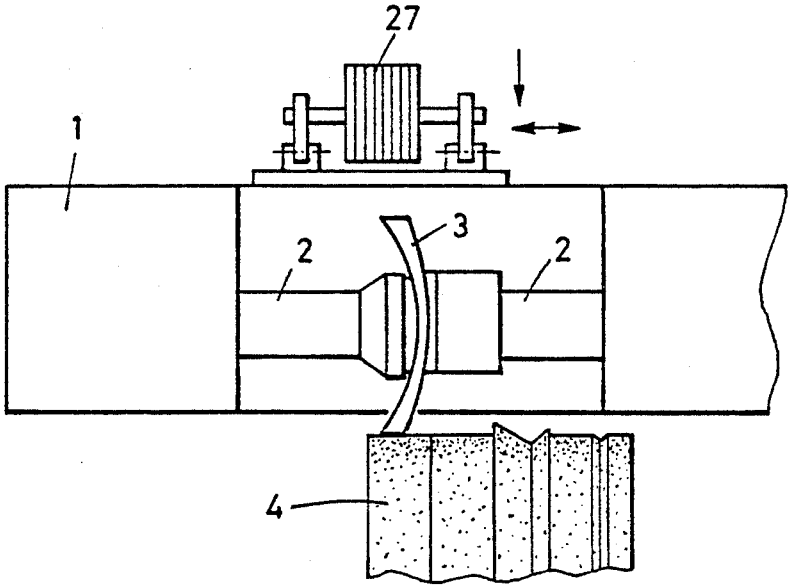
FIG. 5 is a partial diagrammatic view of a modification in which the tracer is mounted on the carriage of the machine.

In the modification shown in FIG. 5, the tracer 27 may be mounted on the carriage 1. However, although the same result is obtained, this modification requires an additional mechanism on the carriage for raising and lowering the tracer into contact with the blank so that this arrangement is more expensive without resulting in any particular advantage.

Arrows it after FIG. 3 in FIG. 3 the cycle of operation of the machine: starting at the end of the trimming of the blank (position A), translation on the tracer B, C, D, raising E, translation on the bevelling grinding wheel F and formation of the bevel G.

As will be understood by those skilled in the art, the driving of the carriage in translation is, of course, controlled for positioning the blank on the tracer.

It will also be observed that, as the radius of the tracer is identical to the radius of the grinding wheel, the device takes into account the grinding point and permits the reading of a theoretically unlimited quantity of measurements on the whole of the periphery of the glass, so that the correcting calculation is eliminated.

It should also be stressed that the invention permits the elimination of the formation of a free bevel by directly passing from the trimming stage to the guided bevelling stage while nonetheless allowing the possibility of producing a free bevel if desired.

We claim:

1. A machine for grinding and bevelling an ophthalmic glass blank, the glass blank having a periphery extending around a glass blank axis and having a front edge and a rear edge, the glass blank having a front-most portion lying in a front-most portion plane, the front-most portion plane extending perpendicular to the glass blank axis comprising: a shaft; grinding wheels carried by said shaft for trimming and bevelling said glass blank; a carriage movable in translation and in oscillation in a direction parallel to and perpendicular to said shaft; tracer means positioned adjacent said grinding wheels for contacting the periphery of the glass blank and for measuring a distance L1 from the front edge of the glass blank to the front-most portion plane and for measuring the distance L2 from the rear edge to the front edge, about the periphery of the blank, said tracer means including a tracer surface having a curvature substantially corresponding to the curvature of the grinding wheels.

2. A machine according to claim 1 wherein the surface of the tracer is formed by adjacent edges of a plurality of juxtaposed, tracer elements movable in a direction perpendicular to the axis of said shaft and sensors positioned to be acted upon by said elements and responsive to displacements of said elements.

3. A machine according to claim 2, wherein said elements are vibratory.

4. A machine according to claim 2, wherein the tracer is disposed on one side of the grinding wheel, the curvature of the surface thereof being concentric with the curvature of the grinding wheel.

5. A machine according to claim 2, wherein the tracer includes three of said elements each positioned to act on a respective sealed sensor.

6. A machine according to claim 2, wherein the tracer is mounted on said carriage to be movable in a direction perpendicular to said shaft carrying the grinding wheel between an upper position remote from the blank and a lower position, in which said lower position said tracer being elastically biased into contact with the edge of the blank.

7. A machine according to claim 1, wherein the tracers are mechanical.

8. A machine according to claim 1, wherein the tracers are magnetic.

9. A machine according to claim 1, wherein the tracers are electronic.

10. A machine according to claim 1, wherein the tracers have a variable resistivity.

* * * * *